United States Patent [19]

Ting

[11] 3,940,591

[45] Feb. 24, 1976

[54] SELF-REGULATING ELECTRIC HEATER

[75] Inventor: Youn H. Ting, Attleboro, Mass.

[73] Assignee: Texas Instruments Incorporated, Dallas, Tex.

[22] Filed: July 1, 1974

[21] Appl. No.: 484,850

[52] U.S. Cl. ..... 219/544; 219/205; 219/311; 219/505; 219/536; 219/541; 338/22 R; 338/274

[51] Int. Cl.[2] ..... H05B 3/02; H01C 7/02

[58] Field of Search ..... 219/200, 209, 210, 205, 219/311, 301, 338, 345, 504, 505, 520, 526, 530, 534, 535, 540, 541, 552, 553; 338/22–24, 25, 28–30, 204, 205, 229, 254, 274, 273, 314, 322, 326, 327, 328, 329, 334

[56] References Cited

UNITED STATES PATENTS

| | | | |
|---|---|---|---|
| 2,606,986 | 8/1952 | Sweger | 338/23 X |
| 2,933,708 | 4/1960 | Elliot et al. | 338/28 |
| 3,338,476 | 8/1967 | Marcoux | 219/505 X |
| 3,375,774 | 4/1968 | Fujimura et al. | 338/22 X |
| 3,564,199 | 2/1971 | Blaha | 219/205 X |
| 3,584,189 | 6/1971 | Marcoux | 219/504 X |
| 3,720,807 | 3/1973 | Ting | 338/22 X |
| 3,748,439 | 7/1973 | Ting et al. | 338/22 X |
| 3,824,328 | 7/1974 | Ting et al. | 338/22 R |

FOREIGN PATENTS OR APPLICATIONS

| | | | |
|---|---|---|---|
| 1,023,500 | 3/1966 | United Kingdom | 338/22 SD |

*Primary Examiner*—A. Baris

*Attorney, Agent, or Firm*—James P. McAndrews; John A. Haug; Russell E. Baumann

[57] ABSTRACT

A self-regulating heater comprising a housing having a chamber therein and a heating element in the chamber. The heating element is a self-heating, positive temperature coefficient (PTC) resistor having low initial resistance which increases abruptly as its temperature rises above a given level. It has first and second substantially parallel surfaces spaced from one another, these surfaces each having a layer of electrically conductive material applied thereto for forming an ohmic contact surface. The heater further comprises a heat sink plate of thermally and electrically conductive material, the plate being positioned within the housing chamber so that one face of the plate is in heat-transfer relation with a first inside surface of the housing and so that the other side of the plate is in electrical contact and in heat transfer relationship with the first surface of the element. Spring means of electrically conductive material is disposed in the chamber between a trough-shaped second inside surface of the housing and the second surface of the element for biasing the heating element and the plate toward and into close heat-transfer relationship with the first inside surface of the housing. "The spring means includes a first portion engageable with the surface of the element and a pair of outer marginal portions bent back on the first portion at an acute angle and resiliently engageable with the trough-shaped surface to guide the spring means as it is inserted into the chamber and to hold the spring means substantially centered with respect to the housing after assembly." First and second terminal means are carried by the plate and by the spring means, respectively, for supplying electrical power to the element. "A dual-sealant seal comprising an inner cast-in place layer of room-temperature vulcanizing rubber material covered by a layer of cast-in place epoxy resin potting material is provided about the electrical leads connected to the first and second terminal means for closing the housing chamber and sealing the leads with respect thereto."

3 Claims, 5 Drawing Figures

SELF-REGULATING ELECTRIC HEATER

BACKGROUND OF THE INVENTION

This invention relates to heaters and more particularly to self-regulating heaters such as may be applied to the exterior of a refrigeration system compressor housing to maintain the lubricant therein above a predetermined temperature level.

In conventional refrigeration components, a refrigerant, such as those sold under the trademark "Freon" by E. I. du Pont de Nemours & Co., may, in liquid form, migrate from the condenser into the compressor lubricant. Upon start-up of the compressor, the sudden reduction in crankcase pressure may cause the refrigerant to boil, thus causing the lubricant to form with consequent loss of lubrication to other mechanical parts of the compressor. It has been conventional to employ a crankcase heater to maintain the compressor crankcase at a temperature above that of the rest of the refrigeration system so as to prevent the migration of refrigerant into the crankcase lubricant.

Formerly, fixed constant-resistance heaters were used for heating the crankcase. However, these heaters were not self-regulating and thus required further temperature controls to limit the heat output of the heater so as to prevent damage to the lubricating oil. These constant-resistance heaters and their associated temperature controls were complicated and expensive. Self-regulating sump heaters are disclosed in the coassigned U.S. Pat. Nos. 3,564,199 and 3,748,439. Briefly, these prior art self-regulating heaters employed a heater made of ceramic material having a positive temperature coefficient (PTC) of resistivity. Such heaters have a relatively low resistance at usual ambient temperatures, but after initial energization by a source of electrical power will self-heat and increase their temperature and resistance. Heat will be generated and the resistance will increase rapidly above a threshold or anomaly temperature until the heat generated balances the heat dissipated at which time the temperature and resistance stabilize with the resistance many times the initial value. Thus, these heaters are self-regulating at a temperature that will not exceed a safe value. Reference may be made to the above-mentioned prior art references for a more complete disclosure of the operating and physical characteristics of PTC heaters.

Many prior art self-regulating heaters utilized potting compounds to electrically insulate the PTC heater from the heater case, to provide increased heat transfer from the heater to the case and to locate the heater within the case. However, it has been found that certain potting compounds, such as epoxy resin materials or the gases emitted therefrom, may deleteriously affect the PTC heater (i.e., react with the PTC material and poison it) when it is operated at high temperatures.

SUMMARY OF THE INVENTION

Among the several objects of this invention may be noted the provision of a self-regulating heater for application to a surface to be heated in which a PTC heater and heat sink means are positively held in optimum heat-transfer relation with the heater housing for insuring the efficient transfer of heat from the heating element to the surface to be heated; the provision of such a self-regulating heater in which the PTC heating element is isolated from any material which may poison the element; the provision of such a self-regulating heater in which at least a portion of the heat emitted from the surface of the heater distal from the surface to be heated is transferred to the heated surface; and the provision of such a self-regulating heater which is easy to assemble, inexpensive in construction and reliable in operation, and which may readily be applied at any desired location to the surface to be heated. Other objects and features of this invention will be in part apparent and in part pointed out hereinafter.

Briefly, a self-regulating heater of this invention comprises a housing having a chamber therein. In the chamber is positioned a heating element which is a self-heating, positive temperature coefficient resistor having low initial resistance which increases abruptly as its temperature rises above a given level. The element has first and second substantially parallel surfaces spaced from one another, these surfaces each having a layer of electrically conductive material applied thereto for forming an ohmic contact surface. The heater further comprises a heat sink plate of thermally and electrically conductive material, the plate being positioned within the housing chamber so that one face of the plate is in heat-transfer relation with a first inside surface of the housing and so that the other side of the plate is in electrical contact and in heat transfer relationship with the first surface of the element. Spring means of electrically conductive material are disposed in the chamber between a second inside surface of the housing and the second surface of the element for biasing the heating element and the plate toward and into close heat-transfer relationship with the first inside surface of the housing. First and second terminal means are carried by the plate and by the spring means, respectively, for supplying electrical power to the element.

BRIEF DESCRIPTION OF THE DRAWINGS

Corresponding reference characters indicate corresponding parts throughout the several views of the drawings.

DESCRIPTION OF A PREFERRED EMBODIMENT

Figure 3:
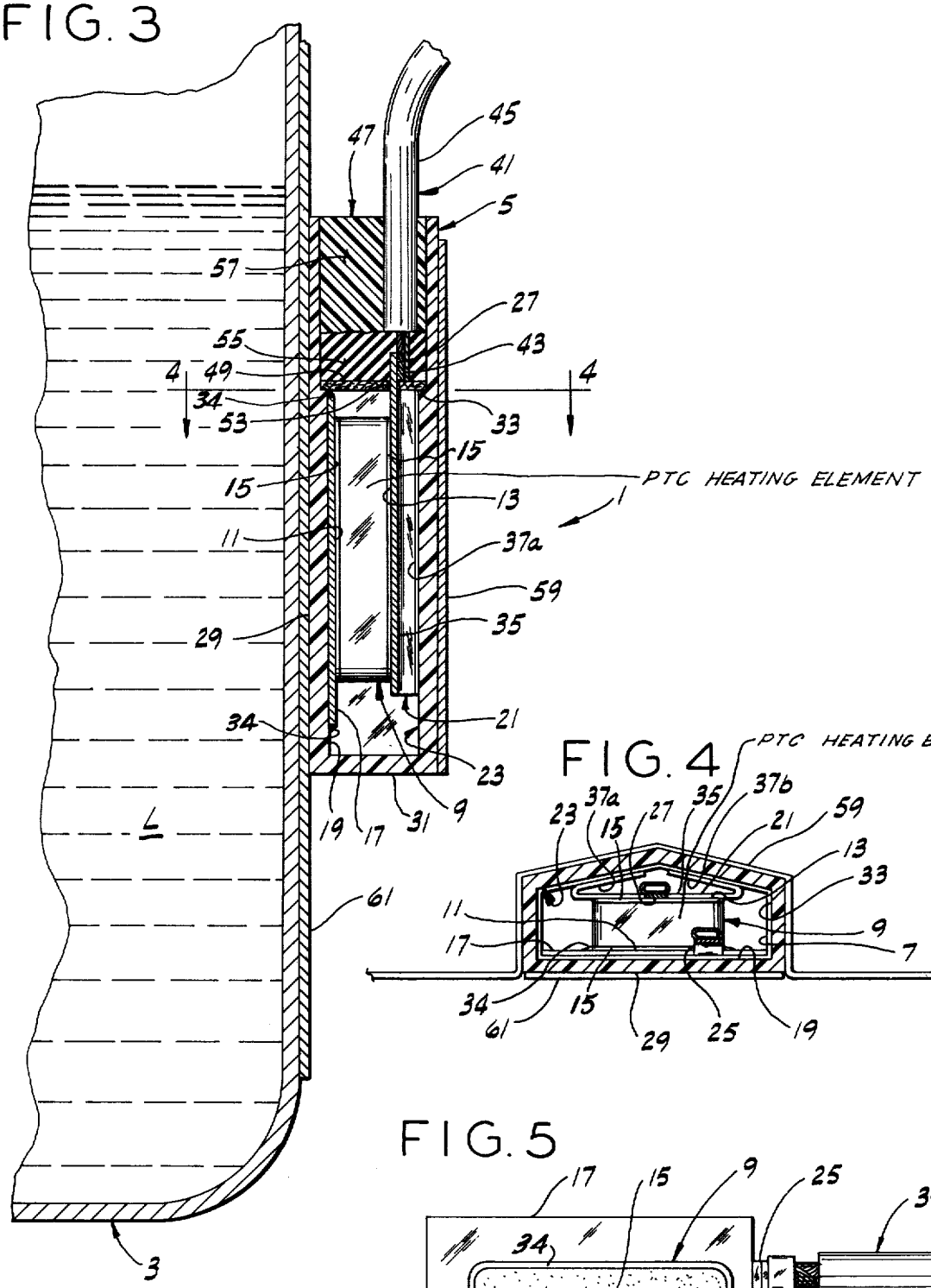
FIG. 3 is an enlarged vertical cross section of the heater as it is applied to the compressor crankcase.

Referring now to the drawings, a self-regulating heater of this invention, indicates in its entirety at 1, is shown secured to the exterior of a refrigeration system compressor crankcase 3 for heating the lubricant L (see FIG. 3) in the crankcase, thereby to prevent the migration of refrigerant from the refrigeration system condenser (not shown) into the lubricant.

More particularly, heater 1 comprises a housing or case 5 of an electrically insulative material, such as a molded phenolic resin or the like, having a chamber 7 therewithin. The heater includes a self-regulating heating element 9 which is a self-heating positive temperature coefficient (PTC) resistor of a ceramic material, e.g., a doped barium titanate, having low initial resistance which increases abruptly as the temperature rises above a given temperature (i.e., this is referred to as its anomaly temperature). Element 9 has a relatively low resistance at usual ambient temperatures (e.g., 550–1000 ohms at 25° C. at 240 volts). Due to its internal resistance, element 9 will self-heat and its resistance will increase until an anomaly temperature (e.g., 115° C.) is reached where its resistance increases abruptly upon further increase in temperature until an equilibrium temperature (e.g., 140° C.) is attained and its resistance may be in the order of 50,000 ohms. At its equilibrium temperature, the heat generated by element 9 is equal to the heat dissipated. Reference may be made to the above-mentioned U.S. patents for a more detailed description of PTC heaters and their resistivity characteristics. This heating element is preferably of a generally rectangular pill-shaped construction with its dimension being apprxoimately 1 inch × 0.5 inch × 0.2 inch but can also be of round or other configuration if desired. The heating element has first and second substantially parallel surfaces 11 and 13, respectively, spaced from one another by the thickness of the element. These surfaces each have a layer of electrically conductive material 15 (e.g., a flame-sprayed aluminum-copper material) applied thereto for forming an ohmic contact surface. This conductive material stops short of the edges of surfaces 11 and 13 (see FIG. 5) and does not extend along the sides of the element.

A heat-sink plate 17 of an electrically and thermally conductive material (e.g., copper) is positioned in chamber 7 so that one face of the plate is in heat-transfer relation (i.e., in contact) with a first inside surface 19 of housing 7. The other face of plate 17 is in electrical contact and heat-transfer relation with surface 11 of heating element 9.

As generally indicated at 21, a spring of electrically conductive material (e.g., a beryllium-copper alloy) is disposed in chamber 7 between a second inside surface 23 of housing 3 (i.e., inverted trough-shaped surface) and the second surface 13 of heating element 9 for biasing the heating element and the plate toward and into closed heat-transfer relationship with the first inside surface 19 of the housing.

Figure 2:
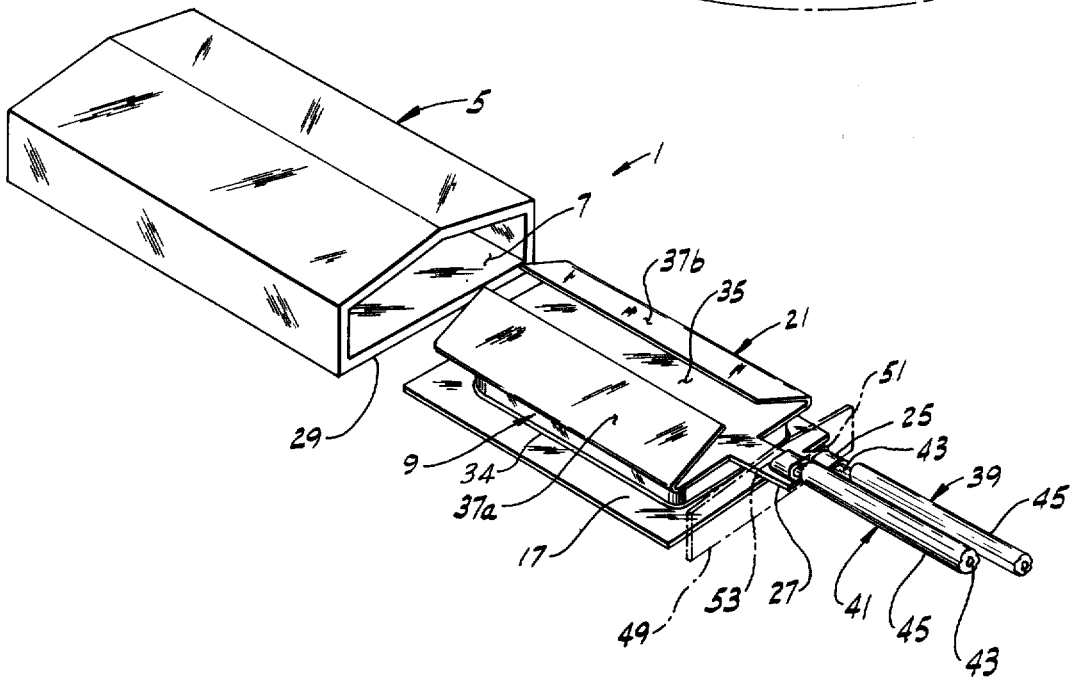
FIG. 2 is an exploded view of the self-regulating heater of FIG. 1.

As best shown in FIG. 2, first and second terminals 25 and 27 are carried by plate 17 and by spring 21, respectively, for supplying electrical power to heating element 9. These terminal members will be described more fully hereinafter.

Figure 4:
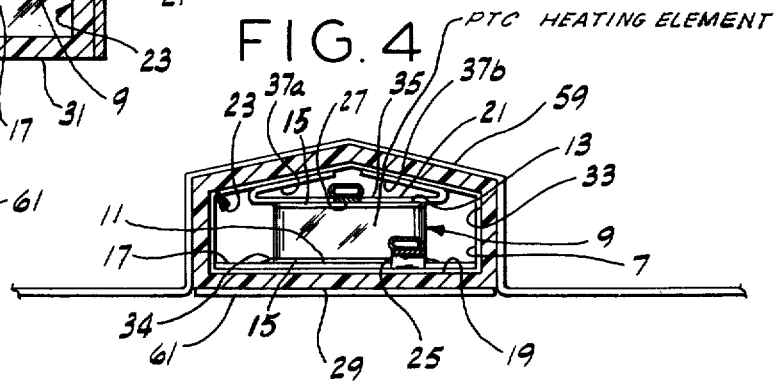
FIG. 4 is a horizontal cross-sectional view taken on line 4—4 of FIG. 3.

More particularly, housing 7 has an outside surface 29 adapted to be placed in heat-transfer relationship with a surface to be heated (e.g., in heat-transfer relationship with crankcase 3). This outside surface is immediately adjacent inside surface 19. One end of the housing is closed, as indicated at 31, so that chamber 7 is blind. As best shown in FIG. 4, both housing 5 and chamber 7 therewithin are pentagon-shaped in cross section with the thickness of the walls of the housing being substantially the same (e.g., approximately 0.065 inch). Housing 3, for example, may be approximately 2 inches long, 1 inch wide, and about 0.5 inch thick. The mouth of chamber 7 is somewhat enlarged (see FIGS. 3 and 4), thereby to provide a shoulder 33 within the chamber for purposes as will appear.

Figure 5:
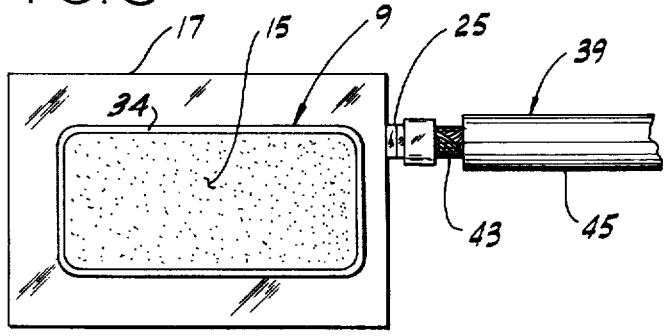
FIG. 5 is an enlarged plan view of a heat-transfer plate and PTC heating element of the heater of this invention.

Plate 17 is sized to have a relatively close fit within chamber 7 and is of somewhat greater width and length than heating element 9 (see FIG. 5). The heating element is secured to the second face of plate 17 to insure good electrical and thermal conduction between the heating element and the heat-transfer plate. Preferably, element 9 is soldered, as indicated at 34, to plate 17 (see FIG. 4). Thus, with plate 17 positioned in chamber 7, heating element 9 is centered substantially widthwise within the chamber.

Spring 21 comprises a one-piece compression spring made of resilient sheet material (e.g., beryllium-copper) having a first or center portion 35 adapted to heat against and to be in good electrical and heat-transfer relation with the second surface 13 of heating element 9 and also has outer marginal portions **37*a*, 37*b* bent back over the center portion 35 at an acute angle (as shown in FIG. 4). When unrestrained, marginal portions 37*a*, 37*b* extend up from the center portion 35 at an angle substantially steeper than the slope of the trough-shaped surface 23. Thus, with spring 21 positioned within chamber 7, marginal portions 37*a*, 37*b* are resiliently forced inwardly to exert a biasing force on heating element 9 and plate 17 to hold the latter in heat-transfer relationship with housing 5. It will be understood that the trough-shaped surface 23 is particularly advantageous as it serves to guide spring 21 into the chamber upon assembling the heater and also maintains the spring centered widthwise with respect to the housing chamber and with respect to element 9 positioned on plate 17**.

Heat-transfer plate 17 has terminal 25 extending from the rear or outer end thereof. This terminal is offset to raise it clear of the adjacent inside chamber surface. Similarly, spring 21 has terminal 27 extending rearwardly from center portion 35. Terminals 25 and 27 each have a respective lead 39 and 41 secured thereto, as by crimping. These leads each include a flexible conductor 43 and an insulative sheat 45 surrounding the conductor. Preferably insulation 45 is sealed with respect to the conductor and prevents transmission of moisutre between the insulator and the conductor.

Heating element 9, plate 17, and spring 21 are hermetically sealed within housing chamber 7 by means of a seal generally indicated at 47 (see FIG. 1) which closes the mouth of the chamber. More particularly, seal 47 comprises a rigid barrier 49 of fish paper or the like conforming generally to the cross section of the mouth of chamber 7. This barrier is adapted to close off the chamber adjacent the rear ends of plate 17 and spring 21 and to abut against shoulder 33 thereby to locate the barrier in the chamber and to maintain it substantially centered in the chamber. As best shown in FIG. 2, barrier 49 has rectangular openings 51 and 53 therethrough for reception of terminals 39 and 41, respectively. It will be understood that the terminals are inserted through their respective openings 51 and 53 prior to leads 39 and 41 being crimped thereto.

Seal 47 further includes a first cast-in-place resilient sealant 55 (see FIG. 3) of resilient sealing material such as a room-temperature vulcanizing (RTV) rubber (e.g., such as that sold under the trade designation "1890 Protective Coating" manufactured by Dow Chemical Company). This RTV sealant material is applied to barrier 49 for sealing the barrier with respect to all adjacent inside housing chamber surfaces and for sealing terminals 25 and 27 relative to their respective openings 51 and 53 through barrier 49. Seal 47 further includes a second cast-in-place seal 57 of a rigid potting compound, such as a two-part epoxy resin material manufactured and sold by the Amicon Corporation under the trademark "T-219". This second cast-in-place sealant 57 surrounds insulation 45 of each lead and closes the mouth of the chamber, seals the leads with respect to the chamber, and relieves strain from the junction of each terminal and its respective lead crimped thereto. This dual-sealant seal 47 is particularly advantageous because the rigid cast-in-place epoxy sealing material 57 effectively and positively seals the leads and hermetically closes the opening to chamber 7. Furthermore, epoxy sealants are stable when exposed to water, and thus effectively prevent long-term water or moisture incursion with attendant damage to the heater. The resilient RTV sealant 55 prevents the epoxy material or any gases emitted therefrom from coming into contact with heating element 9 and thus avoids poisoning of the PTC heating element.

Figure 1:
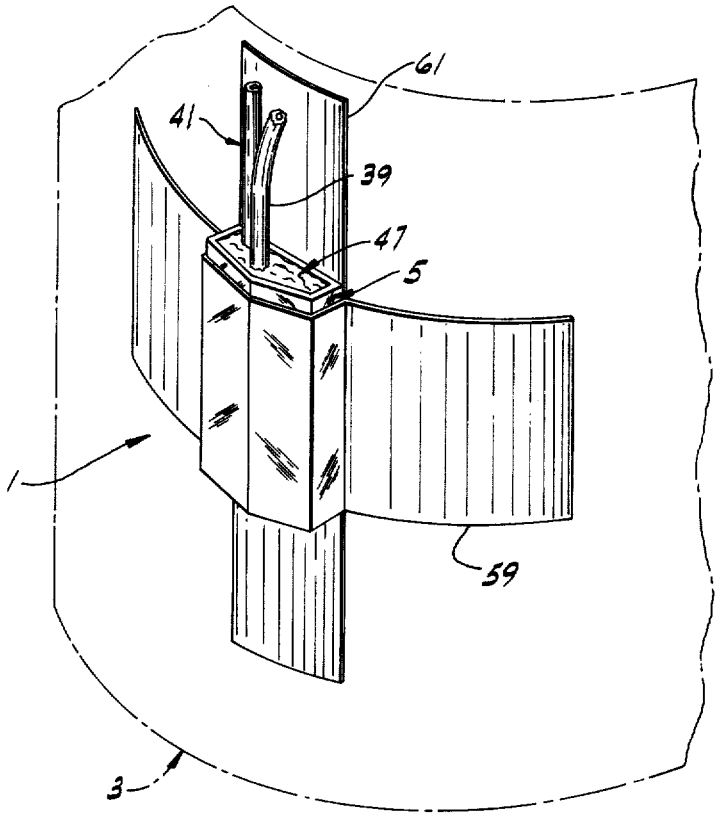
FIG. 1 is a perspective view of a self-regulating heater of this invention as applied to the exterior of a refrigeration compressor crankcase (shown in phantom)

Heater 1 may be readily applied to crankcase 3 by means of adhesive-tape strips 59 and 61. As shown in FIG. 1, strip 59 is applied to the outer and side faces of housing 5 with the outer ends of the tape strip extending from the sides of the housing for being adhered to crankcase 3. Tape strip 61 extends lengthwise of the housing beyond the ends thereof generally at right angles to the strip 59. If preferred, strips 59 and 61 can also be applied directly on top of each other in an in-line fashion, thus making strip 61 parallel to strip 59 instead of perpendicular to strip 59 as shown in FIG. 1. Both tape strips are preferably of a heavy-gauge aluminum foil tape and each has adhesive (not shown) applied to one face thereof for adhering the heater to the crankcase. Strip 61 is held in place on housing 9 by means of the adhesive applied to strip 59 adjacent the sides of the housing.

Spring 21 and tape strip 59 constitute a second heat-sink means for conducting a portion (e.g., approximately 20%) of the heat generated by heating element 9 from the second surface 13 of the heating element to crankcase 3. As previously mentioned, tape strip 59 is an aluminum foil tape which is a good thermal conductor, and spring 21 is made of a good thermal conductor (e.g., beryllium-copper). Thus, heat may readily be conducted from the second surface 13 of heating element 9 to surface 23 of housing 5 via the spring. The heat is then conducted through the housing wall to tape strip 59 and through the tape to the crankcase.

In view of the above, it will be seen that the several objections of the invention are achieved and other advantageous objects attained.

As various changes could be made in the above constructions without departing from the scope of the invention, it is intended that all matter contained in the above description or shown in the accompanying drawings shall be interpreted as illustrative and not in a limiting sense.

What is claimed is:

1. A self-regulating heater comprising:

a housing having a chamber therein;

a heating element constituted by a self-heating positive temperature coefficient resistor having low initial resistance which increases abruptly as its temperature rises above a given level, said element having first and second substantially parallel surfaces spaced from one another, said surfaces each having a layer of electrically conductive material applied thereto for forming an ohmic contact surface;

a heat sink comprising a plate of thermally and electrically conductive material, said heat sink plate being positioned in said housing chamber so that one face of said plate is in heat-transfer relation with a first inside surface of said housing, and so that the other side of said plate is in electrical contact and heat-transfer relation with said first surface of said element;

spring means of electrically conductive material disposed in said chamber between a second inside surface of said housing and said second surface of said element for biasing said heating element and said plate toward and into close heat-transfer relationship with the first inside surface of said housing;

first and second terminal means carried by the plate and spring means, respectively, for supplying electrical power to said element;

said second inside surface of said housing being generally trough-shaped and said spring means comprising a spring member having a first portion engageable with said second surface of said element and an outer marginal portion on each side of said first portion bent back on said first portion at an acute angle, said outer marginal portions being resiliently engageable with said trough-shaped surface thereby to guide the spring member as it is inserted into the chamber, to hold the spring member substantially centered widthwise with respect to the housing after said heater is assembled, and to resiliently maintain said element in heat transfer relationship with said plate and to maintain the latter in heat transfer relationship with said housing.

2. A self-regulating heater comprising:

a housing having a chamber therein which is open at one end to form a chamber mouth and which is closed opposite said mouth;

a heating element constituted by a self-heating positive temperature coefficient resistor having low initial resistance which increases abruptly as its temperature rises above a given level, said element having first and second substantially parallel surfaces spaced from one another, said surfaces each having a layer of electrically conductive material applied thereto for forming an ohmic contact surface;

a heat sink comprising a plate of thermally and electrically conductive material, said heat sink plate being positioned in said housing chamber so that one face of said plate is in heat-transfer relation with a first inside surface of said housing, and so that the other side of said plate is in electrical contact and heat transfer relation with said first surface of said element;

spring means of electrically conductive material disposed in said chamber between a second inside surface of said housing and said second surface of said element for biasing said heating element and said plate toward and into close heat transfer relationship with the first inside surface of said housing;

first and second terminal means carried by the plate and spring means, respectively, for supplying electrical power to said element, said first and second terminal means each having an electrical lead secured thereto extending endwise from the mouth of the housing chamber; and a seal closing the mouth of said chamber for hermetically sealing said plate, said element and said spring means within said chamber, said seal comprising a rigid barrier conforming substantially to the cross section of said housing chamber, said barrier having openings for reception of said terminal means, a cast-in-place resilient hermetically sealing material applied to the exterior side of said barrier for sealing the barrier relative to all adjacent inside housing chamber surfaces and for hermetically sealing said terminal means relative to the barrier and cast-in-place potting material surrounding said leads exteriorly of said sealing material for closing said housing chamber, for sealing said leads with respect to the housing chamber, and for relieving strain from the junction of each terminal means and its respective lead.

3. A self-regulating heater as set forth in claim 1 wherein said cast-in-place resilient sealing material is a room-temperature vulcanizing rubber and said cast-in-place potting material is an epoxy resin, said sealing material preventing the epoxy resin or any gases emitted therefrom from poisoning said element.

* * * * *